US007972445B2

(12) United States Patent
Singh et al.

(10) Patent No.: US 7,972,445 B2
(45) Date of Patent: Jul. 5, 2011

(54) VERTICAL CONTINUOUS VACUUM PAN

(75) Inventors: Jai Parkash Singh, Mohali (IN); Vipin Kumar Gupta, Mohali (IN); Saroj Kumar Singh, Mohali (IN)

(73) Assignee: Spray Engineering Devices Limited, Chandigarth (IN)

( * ) Notice: Subject to any disclaimer, the term of this patent is extended or adjusted under 35 U.S.C. 154(b) by 431 days.

(21) Appl. No.: 12/225,509

(22) PCT Filed: Sep. 25, 2006

(86) PCT No.: PCT/IN2006/000389

§ 371 (c)(1),
(2), (4) Date: Sep. 23, 2008

(87) PCT Pub. No.: WO2007/113849

PCT Pub. Date: Oct. 11, 2007

(65) Prior Publication Data

US 2009/0056706 A1 Mar. 5, 2009

(30) Foreign Application Priority Data

Mar. 30, 2006 (IN) ..... 879/DEL/2006

(51) Int. Cl.
*C13B 30/02* (2006.01)

(52) U.S. Cl. ..... 127/16; 159/25.2; 159/27.1; 202/205

(58) Field of Classification Search ..... 127/16; 159/25.2, 27.1; 202/205
See application file for complete search history.

(56) References Cited

U.S. PATENT DOCUMENTS

| | | | |
|---|---|---|---|
| 3,879,215 | A | 4/1975 | De Villiers et al. |
| 6,991,708 | B2 * | 1/2006 | Schorn et al. ..... 159/27.1 |

FOREIGN PATENT DOCUMENTS

| | | |
|---|---|---|
| EP | 0065775 | 12/1982 |
| EP | 0 201 629 | 11/1986 |
| GB | 1 421 576 | 1/1976 |
| GB | 2 147 217 | 5/1985 |
| WO | 01/91875 | 12/2001 |

OTHER PUBLICATIONS

The Written Opinion of the International Searching Authority for PCT/IN2006/000389, undated.*
Brochure of Crystallization Plants printed Sep. 22, 2008 from www.BMA-de.com.

* cited by examiner

*Primary Examiner* — David A Reifsnyder
(74) *Attorney, Agent, or Firm* — Ladas & Parry LLP

(57) ABSTRACT

The present invention consists of an improved vertical continuous vacuum pan apparatus consisting of eight chambers (2) (instead of four or five) and a storage or buffer tank (27) at the top, within the existing conventional height, characterized in that each chamber has a bottom mounted mechanical circulator housed in an insulated pocket (28) in the vapour space segment (29) of each chamber and not in additional space above the chamber.

29 Claims, 3 Drawing Sheets

VERTICAL CONTINUOUS VACUUM PAN

FIELD OF INVENTION

This invention relates to an improved apparatus for the continuous crystallization of a substance from a solution, using vacuum pan and more particularly, but not exclusively, to continuous crystallization of sugar from a solution in a vertical continuous vacuum pan.

BACKGROUND TO THE INVENTION

Prior Art

Definition of Important Terms:

1. Massecuite: (Pronounced=Mess-kit)

It is a mixture of crystals and mother liquor discharged from a vacuum pan.

2. Calandria: Equipment consisting of closely spaced metal tubes for heat exchange.

The present invention describes an improved apparatus for the continuous production of sugar. The apparatus consists of multiple vacuum chambers or operation chambers arranged vertically, one top of the other. The chambers perform the function of crystallization and evaporation. Each chamber is vertically connected to the next, so that sugar syrup after reaching a particular consistency on undergoing evaporation and crystallization in one chamber, moves to the next, where it undergoes further concentration due to evaporation and crystallization. The process continues in a sequential manner, so that the concentrated product ie. Massecuite is withdrawn from the last chamber. This massecuite is then processed further, to ultimately yield the final crystallized product i.e. sugar.

Conventionally, instead of continuous process, batch process employing vacuum pan, was used. However, it had the following disadvantages:

1. Efficiency: Low efficiency of the crystallizer-evaporator due to all stages being performed in one vessel only;
2. Steam consumption: higher both quantitatively and qualitatively;
3. Product quality: Slow and uneven growth rates.
4. Dead Time: It is the time during which one process is completed and the next has to be started. Since, the process was discontinous, time gap had to be given to clean the vessel and make it operational for a fresh batch, resulting in 'dead time.'
5. Variable load: Fluctuating heating steam demand and variable vapour pressure requirements resulting in higher energy consumption, uneven load on boiler and condenser respectively, resulting in increased cost of production and lowered efficiency of operations.

These disadvantages led to the development of continuous vacuum pans wherein process is carried out by continuously feeding the seed crystals and the sugar solution to an evaporator-crystallizer, while withdrawing the massecuite (highly concentrated suspension) from the evaporator-crystallizer. The continuous apparatus is of two types—vertical and horizontal. In the vertical type, the evaporating-crystallizing compartments are vertically arranged, one on top of the other. In the horizontal type, the same are connected horizontally to each other.

The advantage of the horizontal continuous apparatus was that the average growth function of the crystals was improved, leading to better product quality. Various types of horizontal apparatus have been described in prior art. (Patent Nos. IN161506, IN170702, GB1049798, U.S. Pat. No. 3,627,582, DE2128031).

However, the horizontal type continuous vacuum pan had several disadvantages viz.

a) Product quality variable: large variation in size of final crystals due to short-circuiting of the massecuite flow-path;
b) Processing difficulties: high-purity syrups were difficult to process;
c) Incrustation problem: prone to incrustations, especially in the openings between the compartments. Incrustations are not a desirable feature as they lower heat transfer efficiency and hinder circulation/movement of syrup, reducing yield;
d) Lack of By-passing provision: In horizontal type, all compartments are interconnected and placed in the same vessel. Movement of syrup from one compartment to other occurs continuously, with no provision for bypassing any particular compartment. Hence, in event of maintenance of any one compartment, entire unit has to be halted.
e) Quality reduction in final product: conglomeration & false grain formation is more leading to reduction in quality of final product.
e) Yield reduction: short-circuiting and splashing of massecuite from one compartment to other led to poor or reduced yield.
f) Higher space requirement: requires considerably higher floor space. It may not be possible for a factory using an older type batch pan with mechanical agitator which utilizes much lesser space, to replace it with a continuous horizontal pan.
g) Complex and Costly Design: Continuous vacuum pans have complex and costly design with non-identical compartments.

Various attempts, in horizontal continuous vacuum pans, to remedy the above disadvantages resulted in undesirable complications in apparatus and control systems making the structural and process engineering factors unfavourable. (Patent Nos. U.S. Pat. No. 3,879,215, EP0172965, U.S. Pat. No. 5,201,957 and Patent Application No. US2004177846).

Disadvantages of the horizontal continuous system were overcome by designing a vertical continuous system. It was realized that disadvantages of the horizontal system, especially those connected with the quality of the product crystals viz. large crystal size variation, conglomeration, false grain formation, etc. also arise due to different conditions at separate stages in a pan. Therefore, dissimilar treatment is needed at different stages. The need to accord such a dissimilar treatment led to the proposal of a vertical continuous vacuum pan.

In vertical type apparatus, several mixing vessels with heating and with/without stirring means are mounted one above the other vertically and in communication with each other. Various types of vertical systems have been described in prior art. (Patent Nos. JP52001045, U.S. Pat. No. 4,120,745, EP0065775, EP0201629, DE3839182, FR2695837, and Patent Application No. IN/PCT/2002/02149/CHE)

The importance of massecuite circulation using mechanical circulators (stirrers) in vacuum pans is well established. It has impact on energy, massecuite exhaustion and on sugar quality. As a result pan stirrers (circulators) have been investigated and often used to promote circulation. (Patent Nos. EP0065775, FR2695837) Mechanical circulators (stirrers) have been shown to improve the quality of sugar crystals. The crystals grow more evenly and there are fewer mother liquor inclusions (van der poel 1980, Rieger et al. 1989: Zukerindustrie, 105, 237-240). There is less colour in sugar and reduced risk of sugar losses by local overheating. In addition stirring also reduces centrifugal wash water consumption by 50%. (van der poel 1980: Zukerindustrie, 105, 237-240). Small temperature differences (<12 K) between heating steam and massecuite are only possible with the use of stirrers. A reliable operation without stirrers (mechanical circulation) is not possible and may lead to sedimentation of the crystals (Austmeyer, K. E.; Schliephake, D.; Ekelhof, B.; Sittel, G. (1989): Zukerindustrie 114, 875-878). The use of lower pressure vapours becomes possible (e.g. coming from the $2^{nd}$ or $3^{rd}$ evaporator effect), allowing reduction in the factory steam requirements. Also there is less deposit on the tubes, due to the abrasion effect by friction of the circulating crystals. Those claiming rational circulation without the use of stirrers do so at the cost of simplicity of design and heat economy. (Indian Patent Nos. IN145885, IN169913 and Foreign Patent Nos. U.S. Pat. No. 4,120,745, EP0201629, DE3839182, FR2695837 and Patent Application No. IN/PCT/2002/02149/CHE).

Sugar solution is transferred from one vessel to another in stages with a provision for by-passing a particular chamber by means of appropriate pipelines. Different types of stirrer-equipped vertical continuous apparatus for sugar manufacture have been described in prior art. (Patent Nos. EP0065775, FR2695837) Patent No. EP0065775 (DE3120732) describes an apparatus consisting of two or more chambers of a vacuum pan stacked one upon another wherein bottom of each chamber is surrounded by the passive steam of the chamber below. The preferred version has four superimposed chambers. The agitators of first flowed through chambers are implemented as high-speed mixing agitators and the agitators of the following chambers as rolling over agitators, arranged in each case, on a common shaft.

Major advantages offered by such a system are:

i. Improvement in product quality due to reduction in conglomeration and false grain formation.
ii. Homogenization of the massecuite is obtained.
iii. Long Operating Cycle: The pan is available throughout the campaign without any total plant standstills, even for high-purity massecuites, thereby drastically reducing dead-time.
iv. Optimum adaptation of crystallization chambers and stirrers (mechanical circulators) to process conditions.
v. Energy economy i.e. reduced operational costs.

However, such an arrangement violates a fundamental feature of vertical continuous vacuum pans viz. stirrers mounted on a common shaft present a disadvantage when one of the chambers is taken out of operation for cleaning or other reasons.

In order to overcome the said disadvantage, separately driven stirrers (circulators) for each evaporating-crystallizing chamber were introduced commercially, so that the process was not interrupted when any one chamber was taken out of operation for cleaning etc. This was achieved by introduction of intermediate sections between the chambers, in which were mounted stirrer (circulator) drives and gearbox with the circulator shaft extending through the top cover of each such vessel with a mechanical circulator (impeller) in the downtake. This design of the pan permitted retrofitting of a $5^{th}$ chamber to increase its capacity. (Website of B.M.A. company—www.bma-de.com)

Owing to differences in crystal retention times and consequently in crystal growth, there existed wide crystal size distribution. The underlying cause for it was the limited number of stirrer-equipped evaporating-crystallization chambers.

Since the variation in crystal quality is caused due to limitations of processing owing to limited number of evaporating-crystallization vessels, an apparently simple solution to the problem would be to increase the number of vessels.

In fact, initial thinking and attempts to make evaporating crystallization as a continuous process led to the recognition that because of the widening of the crystal size distribution, this objective could only be achieved if at least 8 chambers with stirrers (circulators) were arranged sequentially (Austmeyer, K. E. 1982; Zuckerindustrie 107, 401-414).

Accordingly, it was first proposed to build a cascade of eight chambers with stirrers of which seven were to be in operation, while one was being cleaned. However, for economic reasons, this concept could not be implemented till date. Major problems associated with an increase in number of treatment chambers are as follows:

1. Increased height of the apparatus;
2. Stirrer shaft becomes very long, both in case of top mounted motor of the mechanical stirrer and in case of stirrers mounted on a common shaft.
3. Associated technical problems: e.g. installation complexities, maintenance problems, increased noise levels, alignment/guidance requirements, etc.

From the above, it is clear that though vertical type continuous apparatus offered distinct advantages over the horizontal system, it also had technical limitations regarding the number of stages which could be incorporated in a single apparatus.

An alternative embodiment proposed in Patent No. EP0065775 with a multiplicity of chambers is, to build the vertical apparatus in the form of two-upright standing towers and to switch the chambers of the towers in such a way that the chambers of each tower are flowed through successively, from above downward. However, such a 'twin-tower' arrangement also has disadvantages.

i) It adds to energy requirements e.g. pumping and
ii) leads to decrease in overall performance and efficiency of the system besides the disadvantages mentioned above.
iii) Also there are problems associated with the bypassing of chambers in such an arrangement.

The present invention has been able to overcome these disadvantages in a novel manner.

A search of Indian patent databases reveals that no patent as for the present invention has been described in the prior art.

OBJECT OF THE INVENTION

The principal object of the invention is to disclose an improved vertical apparatus in which problems of technical limitations and also economy associated with introduction of multiplicity of chambers in a fixed height have been overcome.

Yet another object of the invention to provide an improved vertical continuous evaporation-crystallization apparatus, in which problems of poor crystal quality due to wide crystal size distribution, conglomeration and false grain formation are considerably reduced but economy of operation is maintained.

SUMMARY OF INVENTION

A search of the prior art reveals that though it is highly desirable to have a single vertical continuous vacuum pan of eight chambers for optimum product quality, yet the same has not been implemented at commercial level, due to technical difficulties and economy. The existing apparatus in the state of the art consists of four or five stirrer equipped chambers arranged one on top of the other, occupying a total height of around 31 meters. In the present invention, within the approximately same height, instead of four or five chambers, eight chambers alongwith an additional storage/buffer tank, have been incorporated by using a novel approach. According to this approach, the intermediate space between the chambers which was housing the mechanical circulator drives and gearboxes, has been altogether eliminated without using common shafts for mechanical circulators (stirrers), by housing the drives in specially insulated pockets in the vapor space in each chamber. In addition, another novel approach has been adopted in making the drives bottom mounted, resulting in considerable reduction in shaft length, from 5.0-6.0 meters in existing apparatus to just 0.5-0.56 meters in the present invention, enabling easy installation and maintenance and resulting in power economy.

STATEMENT OF INVENTION

Accordingly, the present invention provides an improved vertical continuous vacuum pan comprising a cylindrical housing having a vertical axis in which plurality of vacuum chambers are stacked one above the other on a common axis characterized in that each chamber has a bottom mounted mechanical circulator housed in an insulated pocket in the vapour space segment of each chamber and not in additional space above the chamber enabling erection of at least eight operation vacuum chambers and a storage or buffer tank at top of the cylindrical housing, in the same height in which previously only 4 or 5 operation chambers were erected, thus eliminating the need for erecting two upright standing towers.

DETAILED DESCRIPTION OF THE INVENTION WITH REFERENCE TO THE DRAWINGS

Figure 1:
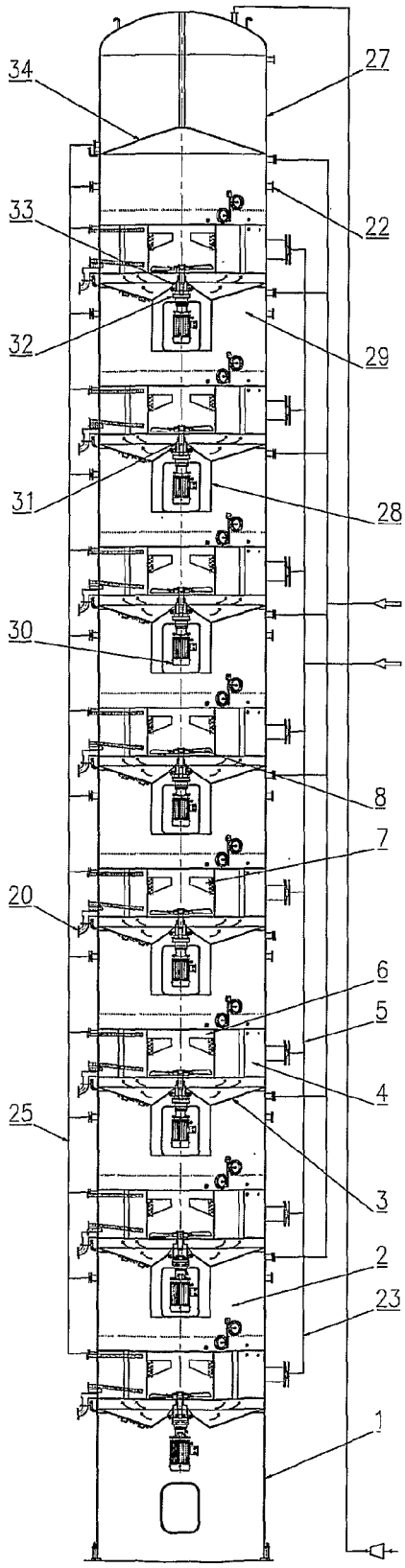
FIG. 1 shows section-elevation of the improved vertical continuous vacuum pan according to the present invention.
Figure 2:
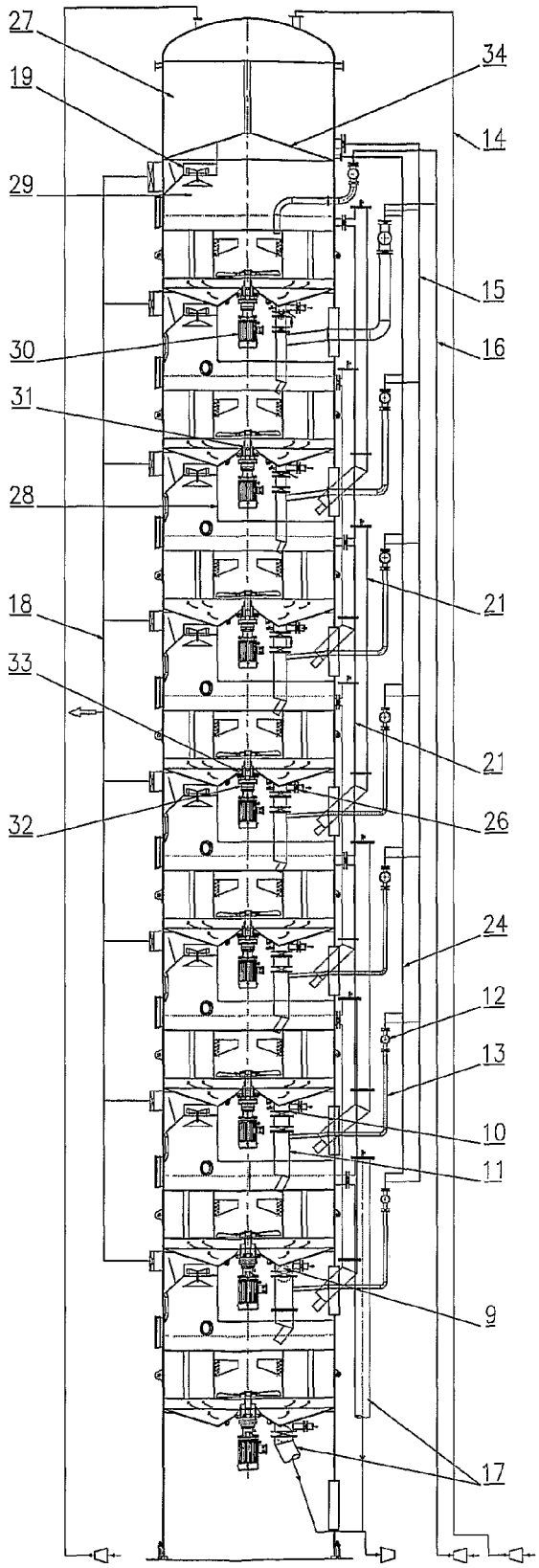
FIG. 2 shows another view of section-elevation of FIG. 1.
Figure 3:
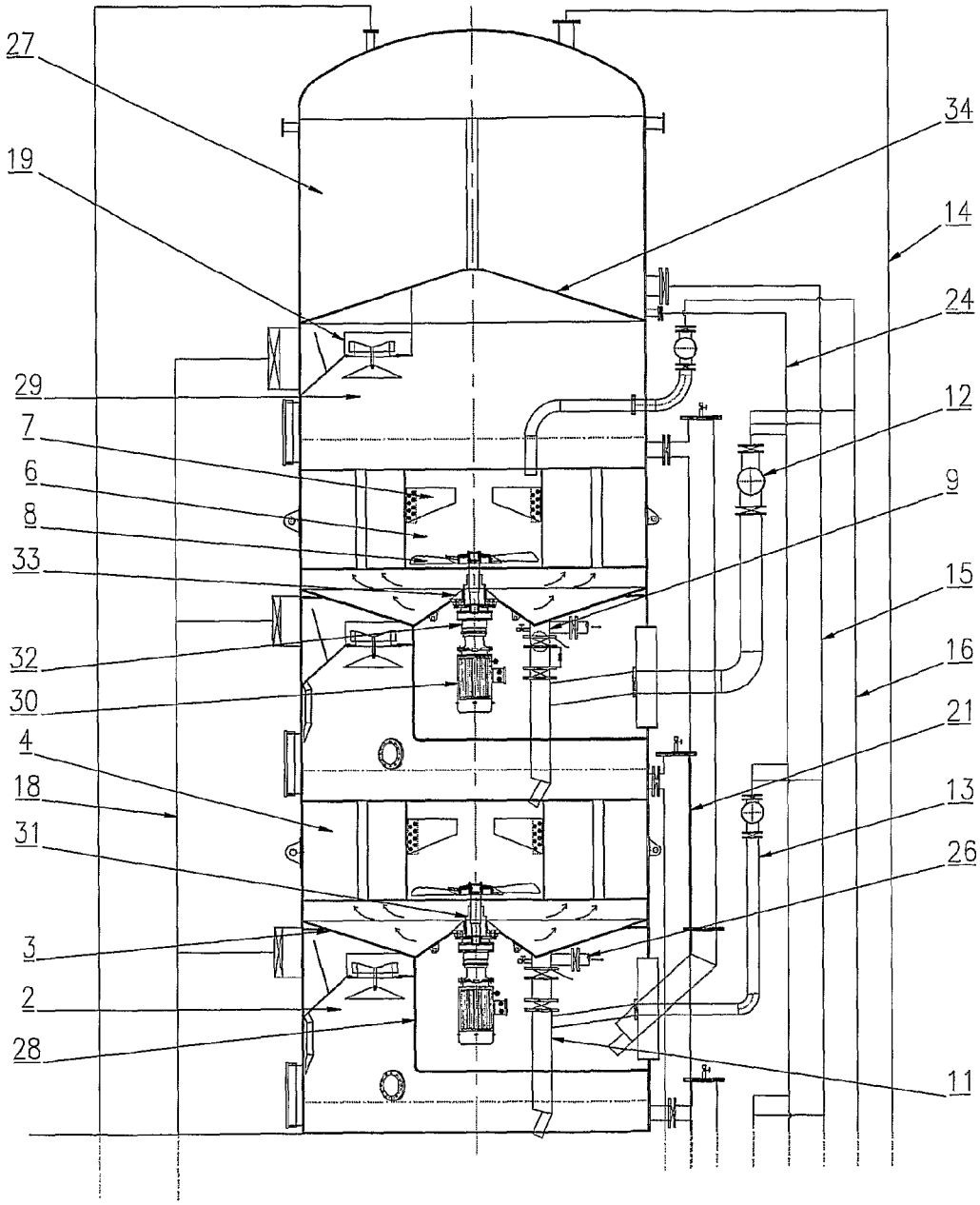
FIG. 3 is enlarged view of top two operation chambers of the pan of FIG. 2.

The present invention consists of an improved vertical continuous vacuum pan apparatus consisting of eight chambers and a storage tank at the top, within the existing conventional height (FIGS. 1 & 2), characterized in that each chamber has a bottom mounted drive housed in an insulated pocket in the vapour space segment of each chamber and not in additional space above the chamber. As a result, the technical problems associated with multiplicity of chambers have been solved in the present invention. Increasing the number of compartments in a vertical apparatus has distinct advantages of increasing product quality, besides economy of operation. However economic limitations prevented the increase in height of the apparatus which could result in number of chambers being increased. Also, technical problems associated with the positioning, installation and maintenance of the stirrer (circulator) drives prevented an increase in the number of chambers within the same apparatus height.

In the new invention, three major innovations have been carried out:

1. Novel utilization of existing space to house stirrer (mechanical circulator) drives: In the present invention, instead of using additional space to house the mechanical circulator assembly, the existing vapor space in each chamber has been utilized to house the drives. This novel arrangement has been made possible by cutting an insulated pocket out of a segment of the vapour space of the lower operation chamber for fitting a bottom driven mechanical stirrer (circulator) in the upwardly tapering cone of the 'W'-shaped bottom in the floor of each operation chamber.

As a result of this, at least 8 (eight) chambers have been erected with an additional storage or buffer tank at the top in approximately same height of around 31 meters in which previously only 4 (four) or 5 (five) chambers were erected. A significant improvement in product quality and throughput is achieved due to higher heating surface and net volume for an apparatus of similar dimensions. It also eliminates the need for erecting two upright standing towers thereby increasing the overall performance and efficiency of the system.

2. Altering position and fitting mechanism of the stirrer (circulator) assembly: The bottom fitted stirrer (circulator) drive & gearbox is a direct mounted in-line planetary drive without coupling and much reduced shaft length, of only about 0.5 m-0.56 m as compared to the conventional shaft length of 5.0 m-6.0 m, thereby enabling easy installation, reducing power consumption, maintenance requirements, elimination of air leakages, thereby making the system compact and enhancing the overall efficiency of the system.

3. Elimination of a common shaft: Each compartment has its own stirrer (circulator) assembly, eliminating the need for a centrally mounted, long shaft, which made maintenance difficult. In contrast, maintenance and cleaning in the present apparatus is much simple.

As a result of these innovations, technical and economic problems which prevented the introduction of multiple chambers in an apparatus of fixed height have been overcome.

The apparatus consists of:

- a cylindrical housing 1 having a vertical axis in which plurality of vacuum chambers 2 are stacked one above the other on a common axis (FIG. 1) each of the vacuum chamber 2 substantially having a 'W'-shaped bottom 3 with space below being surrounded by the passive steam of the chamber below; each operation chamber 2 having associated therewith a fixed set point control for condition of massecuite and discharge volume per hour and that the per hour discharge volume of a given operation chamber is greater than the per hour discharge volume of the immediately preceding operation chamber;
- a heat supply means comprising vertical tube fixed annular calandria 4 supplied by active heating steam from a common supply 5 external to the cylindrical housing;
- a central downtake 6 equipped with swirl breakers 7 and in which an axial flow impeller or a mechanical circulator 8 located in the downtake 6 of each operation chamber 2;
- one or more mechanisms for controlling
  - a) heating steam pressure,
  - b) vapour pressure,
  - c) massecuite condition,
  - d) feed syrup supply proportion and flow rate,
  - e) ratio of feed syrup to seed supply, f) massecuite level, and g) transfer of massecuite from the upper to the lower pan and which transferring means include gravity discharge means;

a massecuite discharge pipe 9 in the floor of every chamber 2 equipped with a control valve 10 regulated by a level sensor of the same chamber and connected to the massecuite supply pipe 11 of the next lower chamber opening in the downtake 6;

a feed box 12 having valve-controlled inlets for seed crystals, feed syrup and hot water and connected to a common inlet pipe 13 out-flowing into massecuite supply pipe 11 in each chamber except the first (top) chamber where it outflows directly into the downtake 6, thereby reducing multiple inlets in each chamber and piping requirements;

a means 14 for introduction of feed syrup in each chamber connected to a common syrup feed header 15 through a control valve regulated by a brix sensor, having an outlet in the feed box 12;

a means 16 for continuously introducing seed crystals into the first operation chamber out-flowing into the feed box 12;

an outlet means 17 for continuously withdrawing sugar syrup and product crystals from the last operation vacuum chamber 2;

means for exhausting vapour and non-condensables through a common vapour line 18 connected to a condenser/vapour recompressor and also equipped with means for entrainment separation 19;

means for removal of condensate 20;

means for bypassing a particular operation chamber 2 by arrangement of appropriate pipes 21;

vacuum break means 22;

means for cleaning comprising valve-controlled steam supply line 23, hot & cold water supply lines 24 & 25 with a wash out drain line 26 connected to the massecuite discharge duct 9 in the floor of the chamber and regulated by a control valve, outflowing into a common wash out drain pipe (not shown).

According to the most salient features of the present invention it will be observed that a novel approach has been adopted enabling erection of at least eight operation vacuum chambers 2 and a storage or buffer tank 27 at top of the cylindrical housing 1, in the same height in which previously only 4 or 5 operation chambers were erected, thus eliminating the need for erecting two upright standing towers thereby increasing the overall performance and efficiency of the system.

This has been made possible by cutting an insulated pocket 28 out of a segment of the vapour space 29 of the lower operation chamber for fitting a bottom driven mechanical stirrer (circulator) in the upwardly tapering cone of the substantially 'W'-shaped bottom in the floor of each operation chamber. The insulated pocket has adequate space for enabling installation and maintenance works.

The said bottom fitted mechanical stirrer (circulator), is a direct mounted in-line planetary drive 30 without coupling and much reduced shaft length, of only about 0.5 m-0.56 m, thereby enabling easy installation, reducing power consumption, maintenance requirements, elimination of air leakages, resulting in increase in overall efficiency of the system. This has been achieved by two factors:

a. Positioning: Positioning of the sealing means & bearing assembly in a special sealing and bearing housing 31 disposed entirely within the vacuum pan operation chamber 2; and b. Use of improved gear-box: use of compact & light weight gearbox 32 of inline planetary type having a hollow spline output and hollow input with key arrangement for direct inline flange mounting of the drive. It is mounted directly onto the bottom of each operation chamber 2 without any coupling and support structure.

Also, drives of lower ratings are installed in mechanical stirrers (circulators) of upper operation chambers than those installed in the last and/or lower operation chambers, without changing the design of the impeller (circulator) vanes, making the system further energy efficient.

The sealing and bearing housing 31 is provided on its outside by an inverted cone 33. The advantage of the said inverted cone 33 is that it avoids stagnation areas adjacent to the housing 31 and assists in the circulation of the massecuite in the vacuum pan operation chamber 2. Further advantage of the inverted cone 33 is that it provides reinforcement to the sealing and bearing housing 31.

An additional feature of the invention is that a storage tank 27 with chambers for syrup, hot water and cold water is mounted at the top of the cylindrical housing 1 i.e. above the operation vacuum chambers 2. It reduces the continuous pumping requirements, the storage tank acting as a buffer for continuous supply, again adding to efficiency of the system. The bottom of the said storage or buffer tank 27 is in the form of an inverted cone 34. The common feed syrup header 15, hot and cold water headers 24 & 25 are connected to their respective outlets from the storage or buffer tank 27.

Another feature is, that entrainment separation means include very compact centrifugal type entrainment separators 19 with upper two operation chambers having four compact entrainment separators and other lower chambers having three compact entrainment separators. Use of light weight compact and multiple entrainment separators instead of a large one has the advantage of easy fabrication, installation and maintenance.

In another embodiment of the invention the uppermost or lowermost operation vacuum chamber may be used as a graining chamber. The said graining chamber operates at a higher strike level than the operation chambers.

A significant improvement in product quality and throughput is achieved in the present invention due to increase in number of chambers within the same dimensions leading to higher heating surface and net volume, while maintaining the economy of operation.

A comparison of the technical features of the present invention with the commercialized apparatus of a leading company is given below and is illustrative:

| S. No. | Feature | VKT* of B.M.A. Company** | Present Invention |
|---|---|---|---|
| 1. | Diameter (mm) | 4800 | 4800 |
| 2. | Height (m) | 31 | 29.5 (excluding storage tank) |
| 3. | No. of chambers | 5 | 8 |
| 4. | Heating Area ($m^2$) | 1200 | 2282 |
| 5. | Net Volume ($m^3$) | 150 | 189 |
| 6. | Massecuite Throughput (tons/hr) | 90 | 130 |

*Apparatus described in EP0065775 and commercialized by the Braunschweigische Masch Bau (B.M.A.) company, known as VKT (Verdampfungs-Kristallisations-Turm i.e. Continuous evaporating crystallization tower)

**(Website: www.bma-de.com).

Due to reduction in retention time ratio with increase in number of compartments in the present invention, coefficient of variation is reduced i.e. sugar with a narrow range of particle size distribution can be produced.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit and scope of the present invention as described.

What is claimed is:

1. A continuous pan crystallization apparatus comprising:

a cylindrical housing having a vertical axis in which plurality of vacuum chambers are stacked one above the other on a common axis;

each said chamber substantially having a W-shaped bottom with space below being surrounded by the passive steam of the chamber below;

each said chamber having associated therewith a fixed set point control for condition of massecuite and discharge volume per hour and that the per hour discharge volume of a given operation chamber is greater than the per hour discharge volume of the immediately preceding operation chamber;

a heat supply means comprising vertical tube fixed annular calandria supplied by active heating steam from a common supply external to the cylindrical housing;

a central downtake in which an axial flow impeller or a mechanical circulator is located;

at least one mechanism operable to control a) heating steam pressure, b) vapour pressure, c) massecuite condition, d) feed syrup supply proportion and flow rate, e) ratio of feed syrup to seed supply, f) massecuite level, and g) transfer of massecuite from the upper to the lower pan using transferring means which include gravity discharge means;

a massecuite discharge pipe in the bottom of every chamber equipped with a control valve regulated by a level sensor of the same chamber and connected to the massecuite supply pipe of the next lower chamber;

an inlet for introduction of feed syrup in each chamber connected to a common syrup feed header through a control valve regulated by a brix sensor; a means for continuously introducing seed crystals into the first operation chamber; an outlet for continuously withdrawing sugar syrup and product crystals from the last operation vacuum chamber; means for exhausting vapour and non-condensables through a common vapour line connected to a condenser/vapour recompressor and also equipped with means for entrainment separation; means for removal of condensate; means for bypassing a particular operation chamber by arrangement of appropriate pipes; means for cleaning comprising valve-controlled steam supply line, hot and cold water supply lines with a wash out drain line connected to the massecuite discharge duct in the floor of the chamber and regulated by a control valve, outflowing into a common wash out drain pipe; each chamber having, a bottom mounted mechanical circulator, all but the lowermost of said mechanical circulators being housed in an insulated pocket in a vapour space segment of a succeeding chamber therebelow.

2. The apparatus as claimed in claim 1, wherein the bottom driven mechanical circulator mounted in the upwardly tapering cone of the substantially W-shaped bottom of each operation chamber is of compact construction with considerably reduced circulator shaft length.

3. The apparatus as claimed in claim 1, wherein the bottom mounted mechanical circulator is provided with a sealing means and a bearing which are disposed entirely inside the operation chamber in a special sealing and bearing housing.

4. The apparatus as claimed in claim 3, wherein the sealing and bearing housing is provided with an inverted cone.

5. The apparatus as claimed in claim 1, wherein the drive of the bottom mounted mechanical circulator is coaxially mounted with a gear box and the gearbox is mounted directly onto the bottom of the each operation chamber without any coupling and support structure.

6. The apparatus as claimed in claim 1, wherein the gearbox is an inline direct mounted planetary gearbox with hollow spline output and hollow input with key arrangement for direct inline flange mounting of the drive.

7. The apparatus as claimed in claim 1, wherein said apparatus includes at least six said chambers, each having a respective mechanical circulator; each of said mechanical circulators has a drive having a rating; the uppermost five of said mechanical circulators having respective drives having a lower rating than at least one drive associated with a lower mechanical circulator, said lower mechanical circulator and said uppermost five of said mechanical circulators having circulator vanes of the same design.

8. The apparatus as claimed in claim 1, wherein the cylindrical housing is provided with a storage or buffer tank with chambers for syrup, hot water and cold water is mounted at the top of the said cylindrical housing.

9. The apparatus as claimed in claim 8, wherein the bottom of the storage or buffer tank is an inverted cone.

10. The apparatus as claimed in claim 1, wherein the common feed syrup header, hot and cold water headers are connected to their respective outlets from the storage or buffer tank.

11. The apparatus as claimed in claim 1, wherein the said chambers have entrainment separation means; said entrainment separation means having centrifugal type entrainment separators with two uppermost ones of said chambers having 4 said entrainment separators and other lower chambers having 3 said entrainment separators.

12. The apparatus as claimed in claim 1, wherein the uppermost or lowermost operation vacuum chamber may be used as a graining chamber.

13. The apparatus as claimed in claim 12, wherein the said graining chamber operates at a higher strike level than the operation chambers.

14. A continuous pan crystallization apparatus, said apparatus comprising:

a plurality of heated chambers stacked one above the other;

said plurality of heated chambers including a first chamber and a second chamber;

said first chamber being an upper chamber, said second chamber being a lower chamber;

said first chamber having an inflow and an outflow;

said second chamber having an inflow and an outflow;

said outflow of said first chamber being operatively connected to feed said inflow of said second chamber;

said first chamber having an circulator mounted therein;

said apparatus including an circulator drive connected to said circulator; and said circulator drive being mounted amidst said second chamber.

15. The continuous pan crystallization apparatus as claimed in claim 14, wherein said apparatus includes a heated third chamber, said third chamber is lower than said second chamber, and said third chamber has an inflow connected to said outflow of said second chamber.

16. The continuous pan crystallization apparatus as claimed in claim 14, wherein said apparatus includes more than five of said heated chambers arranged in a downwardly cascading manner.

17. The continuous pan crystallization apparatus as claimed in claim 14, wherein said apparatus includes eight of said heated chambers arranged in a downwardly cascading manner.

18. The continuous pan crystallization apparatus as claimed in claim 14, wherein said apparatus includes a storage reservoir mounted higher than said first chamber.

19. The continuous pan crystallization apparatus as claimed in claim 14, wherein at least one said circulator drive includes a motor and a planetary reduction gear mounted centrally under said first chamber.

20. The continuous pan crystallization apparatus as claimed in claim 14, wherein a plurality of said circulator drives each include a motor and planetary reduction gear mounted under the respective chamber in which the circulator driven by each drive is mounted.

21. The continuous pan crystallization apparatus as claimed in claim 14, wherein each heated chamber has a circulator, and all of said circulators are independently driven.

22. The continuous pan crystallization apparatus as claimed in claim 14, wherein said apparatus defines a single tower less than 31 m tall.

23. The continuous pan crystallization apparatus as claimed in claim 14, wherein said apparatus includes an insulated enclosure mounted beneath said first chamber, and said first circulator drive is mounted within said insulated enclosure.

24. The continuous pan crystallization apparatus as claimed in claim 14, wherein said second chamber includes a bottom floor defining a syrup pan, and a vapour space defined thereabove, and said first drive is located within an insulated enclosure mounted in said vapour space of said second chamber.

25. The continuous pan crystallization apparatus as claimed in claim 14, wherein said first chamber has a floor defining a bottom of said first chamber, said bottom having a W-shaped cross-section, and said first circulator drive being mounted in an insulated structure nested centrally under said W-shaped cross-section.

26. A continuous pan crystallization apparatus, said apparatus comprising:

a plurality of heated chambers stacked one above the other;

said plurality of heated chambers including a first chamber and a second chamber;

said second chamber being lower than said first chamber;

said first chamber having an inflow and an outflow;

said second chamber having an inflow and an outflow;

said outflow of said first chamber being operatively connected to feed said inflow of said second chamber;

said first chamber having an circulator mounted therein;

said apparatus including an circulator drive connected to said circulator; and said circulator drive being located between said first and second chambers.

27. A continuous pan crystallization apparatus, according to claim 26, wherein said apparatus comprising:

said second chamber has a bottom floor defining a syrup pan, and a vapour space defined thereabove; and said circulator drive being located within an insulated enclosure mounted within said vapour space of said second chamber.

28. A continuous pan crystallization apparatus, said apparatus comprising:

a plurality of heated chambers stacked one above the other;

said plurality of heated chambers including a first chamber and a second chamber;

said second chamber being lower than said first chamber;

said first chamber having an inflow and an outflow;

said second chamber having an inflow and an outflow;

said outflow of said first chamber being operatively connected to feed said inflow of said second chamber;

said first chamber having a floor defining a bottom of a pan for syrup;

said bottom having a W-shaped cross-section said first chamber having an circulator mounted therein;

said apparatus including an circulator drive connected to said circulator; and said circulator drive being mounted beneath said floor nested within said W-shaped section.

29. A continuous pan crystallization apparatus, said apparatus comprising:

a plurality of heated chambers stacked one above the other;

said plurality of heated chambers including a first chamber, a second chamber, and a third chamber;

said second chamber being lower than said first chamber;

said third chamber being lower than said second chamber;

said first chamber having an inflow and an outflow;

said second chamber having an inflow and an outflow;

said third chamber having an inflow and an outflow;

said outflow of said first chamber being operatively connected to feed said inflow of said second chamber;

said outflow of said second chamber being operatively connected to feed said inflow of said third chamber;

said first chamber having a first circulator mounted therein;

said second chamber having a second circulator mounted therein;

said third chamber having a third circulator mounted therein;

said apparatus including a first circulator drive connected to said first circulator, said first circulator drive being mounted below said first chamber;

said apparatus including a second circulator drive connected to said second circulator, said second circulator drive being mounted below said second chamber;

said apparatus including a third circulator drive connected to said third circulator; and said first, second, and third circulator drives being independent of each other whereby said first, second, and third circulators may each be driven at an independent speed.

* * * * *